US009763497B2

(12) United States Patent
Erickson et al.

(10) Patent No.: US 9,763,497 B2
(45) Date of Patent: Sep. 19, 2017

(54) FABRIC FINISHING

(71) Applicant: Velcro BVBA, Deinze (BE)

(72) Inventors: Paul R. Erickson, New Boston, NH (US); David Villeneuve, Bedford, NH (US)

(73) Assignee: Velcro BVBA (BE)

( * ) Notice: Subject to any disclaimer, the term of this patent is extended or adjusted under 35 U.S.C. 154(b) by 0 days.

(21) Appl. No.: 14/920,085

(22) Filed: Oct. 22, 2015

(65) Prior Publication Data

US 2016/0037871 A1 Feb. 11, 2016

Related U.S. Application Data

(62) Division of application No. 13/489,812, filed on Jun. 6, 2012, now Pat. No. 9,206,545.

(Continued)

(51) Int. Cl.
*A44B 18/00* (2006.01)
*D04H 1/68* (2012.01)

(Continued)

(52) U.S. Cl.
CPC ..... *A44B 18/0034* (2013.01); *D04H 1/655* (2013.01); *D04H 1/68* (2013.01); *D06B 19/0094* (2013.01); *D06M 15/507* (2013.01); *D06M 15/564* (2013.01); *D06M 15/71* (2013.01); *D06M 23/04* (2013.01); *D06M 23/08* (2013.01); *D06N 3/0045* (2013.01);

(Continued)

(58) Field of Classification Search
CPC ..... A44B 18/0023; A44B 18/0034
See application file for complete search history.

(56) References Cited

U.S. PATENT DOCUMENTS 3,926,920 A * 12/1975 Georgoudis ..... C09J 167/02 156/332
4,080,928 A 3/1978 Savard (Continued)

FOREIGN PATENT DOCUMENTS

EP 223044 B1 1/1991
EP 342171 B1 12/1993

(Continued)

OTHER PUBLICATIONS

International Preliminary Examination Report on Patentability for PCT/US2012/040672 mailed Oct. 11, 2013.

(Continued)

*Primary Examiner* — Jeff Aftergut
*Assistant Examiner* — Jaeyun Lee
(74) *Attorney, Agent, or Firm* — Fish & Richardson P.C.

(57) ABSTRACT

A fabric, such as a loop fastener material, is finished by applying a foam to a surface of the fabric, the foam containing both a liquid binder and a powder. The binder is allowed to flow into pores of the fabric and coat fiber interstices of the fabric as the foam collapses, and is dried to stabilize the fabric. The powder is of a particle size selected to cause most of the powder to remain on the surface of the fabric while the binder is dried to bond the powder to the fabric surface. The powder, as bonded to the fabric surface, is activatable, such as by heat or RF or UV energy, to adhere the stabilized fabric to another surface or to provide a desired surface property.

15 Claims, 5 Drawing Sheets

Related U.S. Application Data

(60) Provisional application No. 61/511,856, filed on Jul. 26, 2011.

(51) Int. Cl.

| | |
|---|---|
| ***D06M 23/04*** | (2006.01) |
| ***D06M 23/08*** | (2006.01) |
| ***D06B 19/00*** | (2006.01) |
| ***D04H 1/655*** | (2012.01) |
| ***D06N 3/00*** | (2006.01) |
| ***D06M 15/507*** | (2006.01) |
| ***D06M 15/564*** | (2006.01) |
| ***D06M 15/71*** | (2006.01) |
| *B05C 5/02* | (2006.01) |
| *D06M 101/32* | (2006.01) |
| *D06M 101/34* | (2006.01) |

(52) U.S. Cl.
CPC ..... *D06N 3/0068* (2013.01); *B05C 5/0245* (2013.01); *B05C 5/0254* (2013.01); *D06M 2101/32* (2013.01); *D06M 2101/34* (2013.01)

(56) References Cited

U.S. PATENT DOCUMENTS

| | | | | |
|---|---|---|---|---|
| 4,340,632 | A * | 7/1982 | Wells | D06Q 1/06 156/230 |
| 4,748,044 | A | 5/1988 | Fottinger et al. | |
| 4,847,116 | A | 7/1989 | Duit | |
| 4,973,326 | A * | 11/1990 | Wood | A61F 13/622 24/450 |
| 5,102,701 | A | 4/1992 | Davis et al. | |
| 5,227,227 | A | 7/1993 | Boulanger | |
| 5,614,281 | A | 3/1997 | Jackson et al. | |
| 5,773,120 | A | 6/1998 | Deka et al. | |
| 6,329,016 | B1 | 12/2001 | Shepard et al. | |
| 6,342,285 | B1 | 1/2002 | Shepard et al. | |
| 6,681,457 | B2 | 1/2004 | Okawa et al. | |
| 6,869,659 | B2 | 3/2005 | Shepard et al. | |
| 7,048,818 | B2 | 5/2006 | Krantz et al. | |
| 7,132,144 | B2 | 11/2006 | Roberts | |
| 7,156,937 | B2 | 1/2007 | Provost et al. | |
| 7,373,699 | B2 | 5/2008 | Erickson et al. | |
| 7,491,438 | B2 | 2/2009 | Demott et al. | |
| 7,871,672 | B2 | 1/2011 | Crook et al. | |
| 8,082,637 | B2 | 12/2011 | Tolan et al. | |
| 8,535,776 | B2 | 9/2013 | Erickson | |
| 2001/0003797 | A1 * | 6/2001 | Guevara | A61F 13/15252 604/364 |
| 2003/0083413 | A1 | 5/2003 | Stumphauzer | |
| 2004/0121694 | A1 | 6/2004 | Shepard et al. | |
| 2004/0157036 | A1 | 8/2004 | Provost et al. | |
| 2005/0075028 | A1 | 4/2005 | Rock et al. | |
| 2005/0196580 | A1 | 9/2005 | Provost et al. | |
| 2005/0233662 | A1 | 10/2005 | Kimbrell et al. | |
| 2007/0026181 | A1 * | 2/2007 | Roberts | A44B 18/0073 428/40.1 |
| 2007/0270064 | A1 | 11/2007 | Aseere | |
| 2009/0217492 | A1 * | 9/2009 | Gallant | A44B 18/0003 24/306 |
| 2010/0247846 | A1 | 9/2010 | Erickson | |
| 2012/0122365 | A1 | 5/2012 | Erickson | |

FOREIGN PATENT DOCUMENTS

| | | | |
|---|---|---|---|
| WO | WO9216681 | A1 | 10/1992 |
| WO | WO9911452 | A1 | 3/1999 |
| WO | WO2004077982 | A8 | 1/2006 |

OTHER PUBLICATIONS

Written Opinion of the International Preliminary Examining Authority for PCT/US2012/040672 mailed Jul. 16, 2013.

International Search Report and Written Opinion for PCT/US2012/040672 mailed Sep. 20, 2012.

* cited by examiner

FABRIC FINISHING

CROSS-REFERENCE TO RELATED APPLICATIONS

This application is a divisional of U.S. Ser. No. 13/489,812, filed Jun. 6, 2012, which claims priority under 35 U.S.C. §119(e) from U.S. provisional application 61/511,856, filed Jul. 26, 2011. The entire contents of these applications are incorporated herein by reference in their entireties.

TECHNICAL FIELD

This invention relates to finishing fabrics, such as fastener loop fabrics, and to seizing free edges of fabrics.

BACKGROUND

Fabrics often go through several processes, often sequentially, to provide all of the qualities desired in a finished fabric. Fabrics that are to function as the loop portion of a hook-and-loop fastener have additional requirements, in that the loops must remain functional for their intended purpose, and must be anchored sufficiently to resist being easily pulled out during use. Providing the necessary mechanical strength can be challenging in particularly lightweight loop materials.

Many fabrics are also required to have certain surface properties, and for that purpose it is common to provide coatings and the like on fabrics. On loop fastener fabrics, coatings may be applied to the non-fastening surface of the loop material, such as to reduce permeability or to provide a layer for adhering or welding the material to something else.

Improvements are continually sought in the methods and processes employed to finish fabrics, and to efficiently provide fabrics with desired bulk and surface properties.

SUMMARY

Several aspects of the invention feature fabrics finished with both a binder that flows into the fabric, and an activatable material that stays sufficiently on a surface of the fabric, such as to enable later bonding of the fabric upon activation.

One aspect of the invention features a method of finishing a fabric, the method including applying a foam to a surface of a fabric (the foam comprising a liquid binder and a powder), allowing the liquid binder to flow into pores of the fabric and coat fiber interstices of the fabric as the foam collapses, and drying the binder coating the fiber interstices, so as to stabilize the fabric. The powder is of a particle size selected to cause most of the powder to remain on the surface of the fabric while the binder is dried to bond the powder to the fabric surface. The powder, as bonded to the fabric surface, is activatable to alter a surface property of the fabric upon activation.

A discrete particle of powder is "on the surface" of a fabric if at least a portion of the particle is closer to an outermost extent of the fabric than a nominal diameter of the yarn (or if monofilament, the filament) forming the fabric surface and most adjacent the particle, with the particle being exposed in the sense that it is not covered by the fabric yarn or filaments. Such particles will be, in most cases, available for interaction with other materials brought into contact with the fabric under pressure and under suitable conditions to cause the particles to be activated.

In some cases, the powder is dispersed in the liquid binder as the foam is applied to the surface of the fabric.

In some examples, the foam contains one part powder to ten parts binder, by weight. For some applications, the powder comprises at least 50 percent, by weight, of the foam.

The binder may be, for example, an acrylic (such as a water-based acrylic) or a urethane. The powder may comprise, for example, co-polyamide or co-polyester resin. The powder may comprise a vinyl.

In some applications the powder, as bonded to the fabric surface, is heat-activatable and/or RF-activatable, such as to adhere the stabilized fabric to another surface.

In some embodiments, such as for finishing a fabric to be positioned against the skin, the fabric, as stabilized, is air-permeable.

The fabric may be, for example, a knit.

In some examples the powder includes a first set of particles formed of a first resin, and a second set of particles formed of a second resin. In some cases the first and second sets of particles having different activation properties, such that the first set of particles is activatable under conditions in which the second set of particles is substantially unactivated. In some cases the first and second resins having different bonding characteristics when activated.

Another aspect of the invention features a method of finishing a fastener loop material. The method includes applying a coating to a surface of a fastener loop material opposite hook-engageable loops of the material (the coating comprising a liquid binder and a suspended, activatable powder), allowing the liquid binder of the coating to flow into the loop material and coat fiber interstices of the loop material, and then drying the flowed binder to anchor loop fibers of the loop material. A sufficient amount of the activatable powder remains on the surface of the loop material after the binder is dried, to form an activatable surface adhesive for bonding the loop material to another surface.

In some cases, the coating is applied as a foam containing the powder in suspension.

In some examples, the loop material has an equivalent ground porosity of between 55% and 80% before applying the coating. In some cases, the loop material has a woven ground.

Various embodiments of this aspect of the invention feature details described above with respect to the first aspect of the invention.

Another aspect of the invention features a method of bonding a fastener loop material to a mounting surface. The method includes activating a surface of a fastener loop material opposite hook-engageable loops of the material to cause particles of resin at the surface of the loop material to soften (the particles being held to the loop material by a dried binder), and bringing the surface of the loop material into contact with the mounting surface. Softened particles of resin at the activated surface bond the loop material to the mounting surface, with hook-engageable loops of the loop material exposed for hook engagement.

In some cases, the surface of the fastener loop material is activated after being brought into contact with the mounting surface.

Activating the surface of the fastener loop material, in some examples, includes applying heat to raise a temperature of the resin particles above a softening point of the resin particles but below a melting point of the dried binder, and/or applying energy at a radio frequency under conditions that cause the resin particles to soften without significantly softening the dried binder or resin of the loops.

Various embodiments of this aspect begin with a material finished according to the methods described above.

Another aspect of the invention features a method of seizing a free edge of a fabric. The method includes applying a flowable material to a region of a surface of a fabric where a free edge is to be formed (the flowable material comprising a liquid binder and an activatable powder), allowing the liquid binder to flow into pores of the fabric and coat fiber interstices of the fabric in the region, drying the binder coating the fiber interstices, so as to stabilize the fabric in the region, and then cutting the fabric to form a free edge in the region. The fabric is cut under conditions that cause the powder to activate along the free edge and flow to seize free ends of cut fibers at the free edge.

Various embodiments of this aspect feature details of the finishing methods described above.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
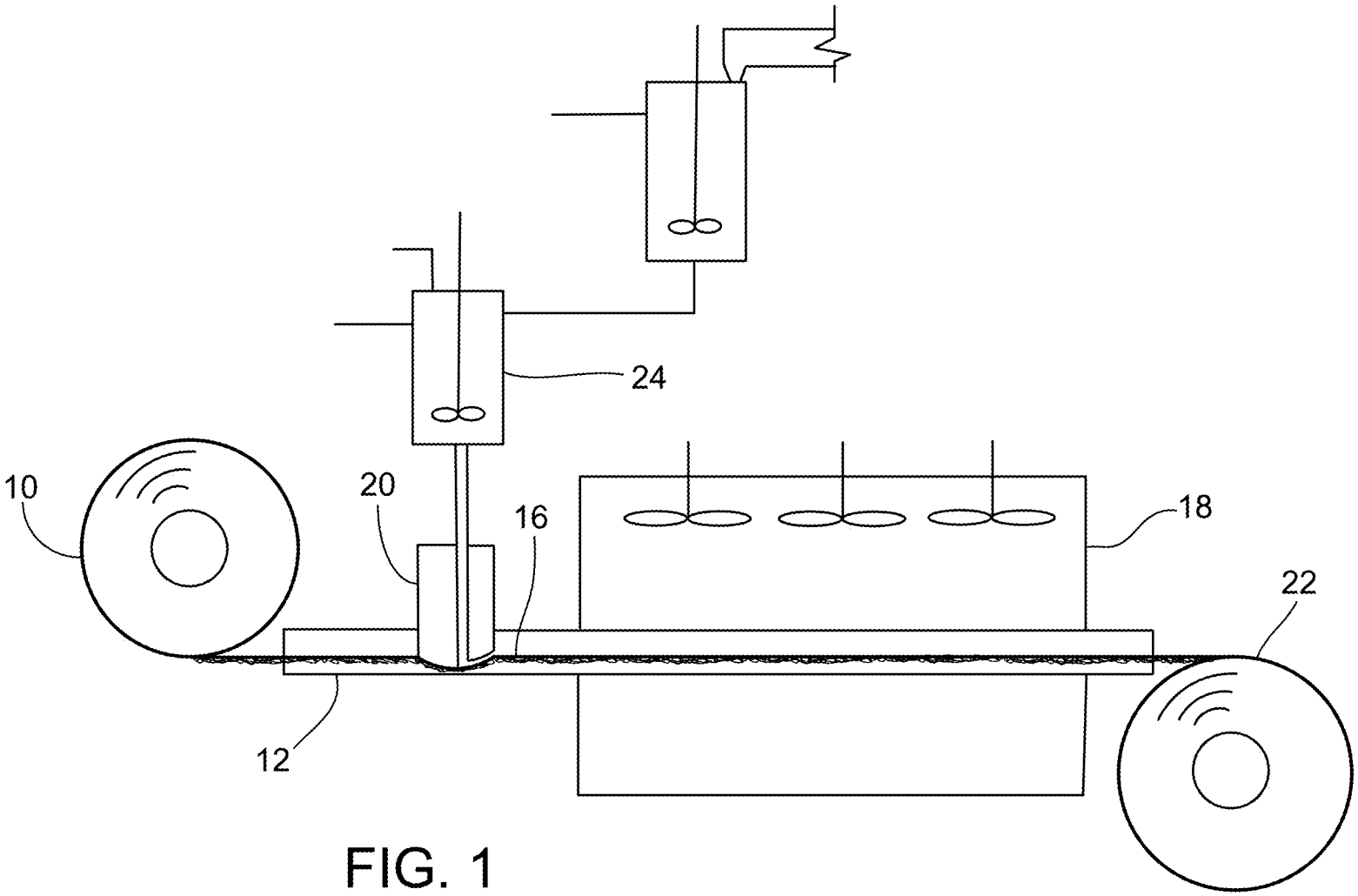
FIG. 1 is a schematic representation of an apparatus and method for finishing a fabric.

Referring first to FIG. 1, a precursor fabric 10 to be finished is fed into a tenter frame 12, where the fabric is held taut within its plane, and in some cases stretched a desired amount, either in machine or cross-machine direction, or both, as the fabric is finished. While held on the tenter frame 12, a foam 16 is applied to an upper surface of the fabric before the fabric enters a forced convection dryer 18. The foam is applied by a coater head 20, such as a Gaston County parabolic coater extending across the width of the fabric. The coater may be configured in either a coat-up or coat-down configuration, depending on the amount of gravity-enhanced wicking desired.

The coater head 20 is positioned far enough in advance of dryer 18 that the applied, unstable foam has enough time to collapse, liquid of the collapsed foam wicking through pores of the fabric and into fiber interstices before water and volatiles of the collapsed foam are driven off in the dryer. The foam may be either laid on the fabric, or applied under some pressure. The dried, finished fabric 22 is then removed from the tenter frame and spooled for shipment.

The unfinished precursor fabric 10 in this example is a 2-bar warp knit nylon loop fastener material, part number 3368-9999 from Velcro USA Inc. in Manchester, N.H. The 3368-9999 knit fabric is uncoated and has an overall thickness of about 0.068 inch and a basis weight of 6.2 osy as introduced to the tenter frame. In other examples the precursor fabric is a circular knit or a woven loop material. Non-woven materials may also be employed under appropriate conditions.

The foam 16 applied to the non-loop (i.e., the technical face) of fabric 10 while held on the tenter frame is a foamed mixture comprising a binder and a powder as the two principal ingredients, along with ancillary components as needed to affect the desired suspension of the powder within the foam. In this example the binder is a water-based acrylic available from Celanese Ltd of Dallas, Tex., as DUR-O-CRYL 69A. HI LOFT AR-7, also available from Celanese, has been found to be a good substitute acrylic when a little stiffer finish is desired. Solvent-based acrylics and urethanes are also available.

The powder is supplied premixed into a paste containing the powder, a lubricant, a dispersing agent and a thickener, in water. The paste is about ⅔ water and about 20 percent powder, by weight. The powder in this example is a co-polyester powder available from EMS-CHEMIE as GRIL-TEX D 1365E, sieved to a 0-80 micron particle size. In some cases, co-polyester may be preferred for use on polyester fabrics, and co-polyamide powder for use on nylon fabric, to improve the interface bond. In some cases, as discussed below, multiple types of powder are combined in the paste. Particle sizes up to 120 micron may be employed as desired, although extra care may need to be taken to avoid streaking at higher particle sizes. Other powders that may be applied in this manner are vinyl powders or even rubber powders.

The paste and binder are combined in a mixing tank 24, along with a foaming agent, and pumped less than 30 feet to coater head 20. A surfactant may be added as needed. The foamed mixture is applied continuously and before significant settling of the powder has occurred. In this example the final mixture was foamed with a blow ratio of about 5:1 and applied in sufficient volume that the finished material 22 has a basis weight, as dried, of about 8.1 osy. In other words, about 1.9 osy of solids (accounting for more than 20 percent of the weight of the finished fabric) are applied at the coater head. In some other examples the blow ratio may be as high as 10:1 or even 20:1.

Although in the example described above the fabric is coated across its extent and along its length with an unstable foam that covers the entire area of the fabric, in other examples the foam is applied to less than the entire fabric area. For example, the foam may be applied through a patterned screen onto only discrete regions of the fabric, thereby applying a desired pattern of the binder and powder. Such a discontinuous application may permit a stretchable fabric to maintain some stretchiness as finished, for example. Or the application pattern may apply activatable powders only to regions where an adhesive surface coating is desired.

The powders mixed into the paste may be produced by known methods, including by grinding frozen resin pellets. Ragged powder shapes may be more conducive, in some applications to rapid RF or heat activation.

Figure 2:
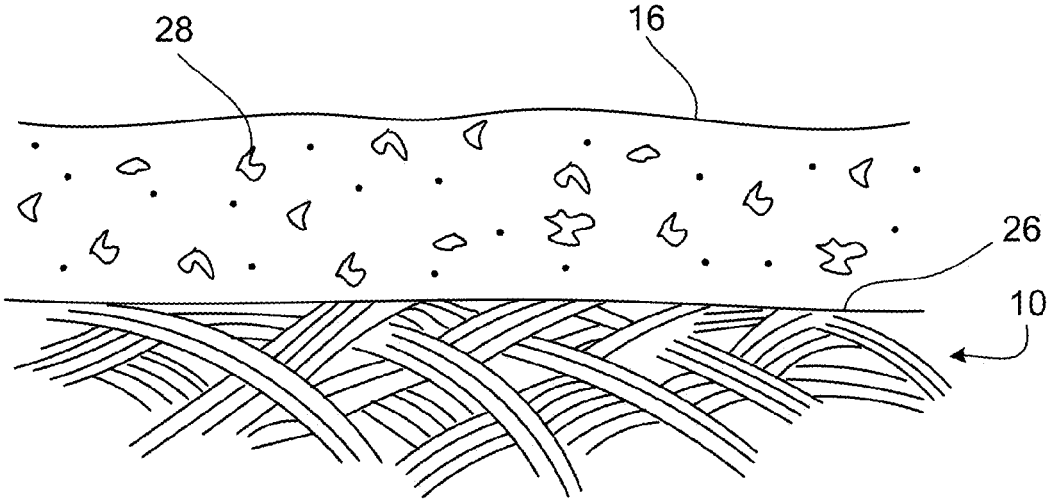
FIG. 2 is a schematic cross-sectional view through the surface of the precursor fabric of FIG. 1, immediately downstream of the coater head.

Referring next to FIG. 2, the foam 16 as initially applied to the surface 26 of fabric 10 contains powder 28 as discrete, suspended particles dispersed throughout the foam. As the coated fabric approaches the dryer, the foam collapses and the liquid binder of the foam penetrates the fabric and wicks into interstices between yarns and into the yarns themselves, thereby helping to anchor or bind the fibers that form the engageable loops, increasing the performance of the loop material as a fastener once the binder has dried. Some of the powder, particularly the smaller particles, also penetrates the fabric surface. However, as the foam collapses enough of the powder remains exposed at the surface of the fabric so as to impart an activatable surface property to the overall fabric.

Figure 3:
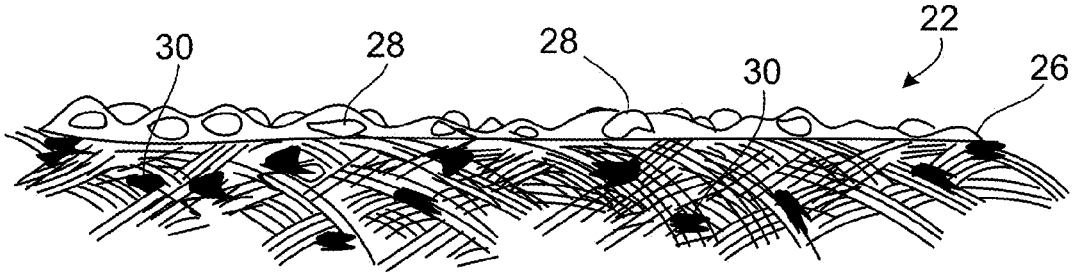
FIG. 3 is the schematic cross-sectional view of FIG. 2, taken after the foam has collapsed and the binder wicked into the fabric.

FIG. 3 schematically illustrates the fabric 22 after the foam has collapsed and the binder 30 has wicked into the yarns and dried, leaving a substantial amount, or most, of the powder 28 at the surface of the fabric. If desired, the fines and smaller particles of the powder may be sieved from the powder before the paste is formed, to reduce the proportion of the powder that penetrates the fabric. This may be particularly useful in connection with a fabric having larger pores or openings at the surface. The powder 28 remains secured to the fabric by wetting of the binder 30 to the individual powder particles. Some of the powder at the surface may be covered by a thin film of dried binder, while some of the powder may be uncovered.

The surface 26 of the finished fabric is thus provided with an activatable surface characteristic during the same processing steps that result in the binding of the fibers within the fabric.

One of the uses envisioned for this method is to provide a surface that may be later activated to become adhesive or tacky, such as for bonding the fabric or loop material to another material or surface. In the example discussed above, the co-polyester powder functions as a hot melt resin material distributed over the surface of the back of the loop material, non-adhesive during spooling and storage of the material but readily activatable by heat to bond segments of the loop material to another product. Under some conditions, the co-polyester powder also provides the fabric surface with RF-weldable properties. For welding, the powder material may be selected to have a particular affinity or compatibility with the material of a surface onto which the fabric or loop material is to be welded. For example, a vinyl powder may be employed if the chief purpose of the fabric is to be welded to a vinyl surface.

As mentioned above, multiple powders may be employed so as to provide multiple activation functions of the surface of the fabric. For example, one powder of a material having a particularly low melting point may be included to give the fabric surface a hot melt adhesive property, such as for initial, repositionable assembly onto a product, while another powder may be included of a material that does not melt during initial assembly but does activate by RF energy to make a permanent weld to the product after final positioning. Another example of sequential activation would be to activate a first powder at the surface to releasably bond a cover over the fabric, for later removal before making a permanent bond with a second powder at the surface. In another example, powders of two different materials are included (e.g., both a PET and a urethane), each providing a particular compatibility with a different type of surface to which the fabric may be later bonded.

Other activatable surface properties are envisioned, beyond adhesive properties. For example, the powder remaining principally at the fabric surface may be later activated by UV or RF energy to cross-link and thereby significantly increase the stiffness of the fabric surface or to reduce or eliminate the stretchiness of the fabric.

In some cases the fabric is woven with sheathed core ground fibers that have a core of one material (e.g., nylon or polyester) sheathed with another material (e.g., co-PET). The binder may be, for example, a urethane. The sheath material may be of a lower melt point than the core temperature, or otherwise selected to enhance RF-weldability. In such cases both the powder and the sheath material may interact with the other surface to provide an enhanced bond, or the powder may be formulated to be activated under one set of conditions, and the sheath material may be activated under a different set of conditions. In such cases, the finished fabric may be configured for two distinct functions, one provided by the sheath material of the ground fibers and the other provided by the adhesive powder. The functions may be bonding with different materials, for example.

Figure 4:
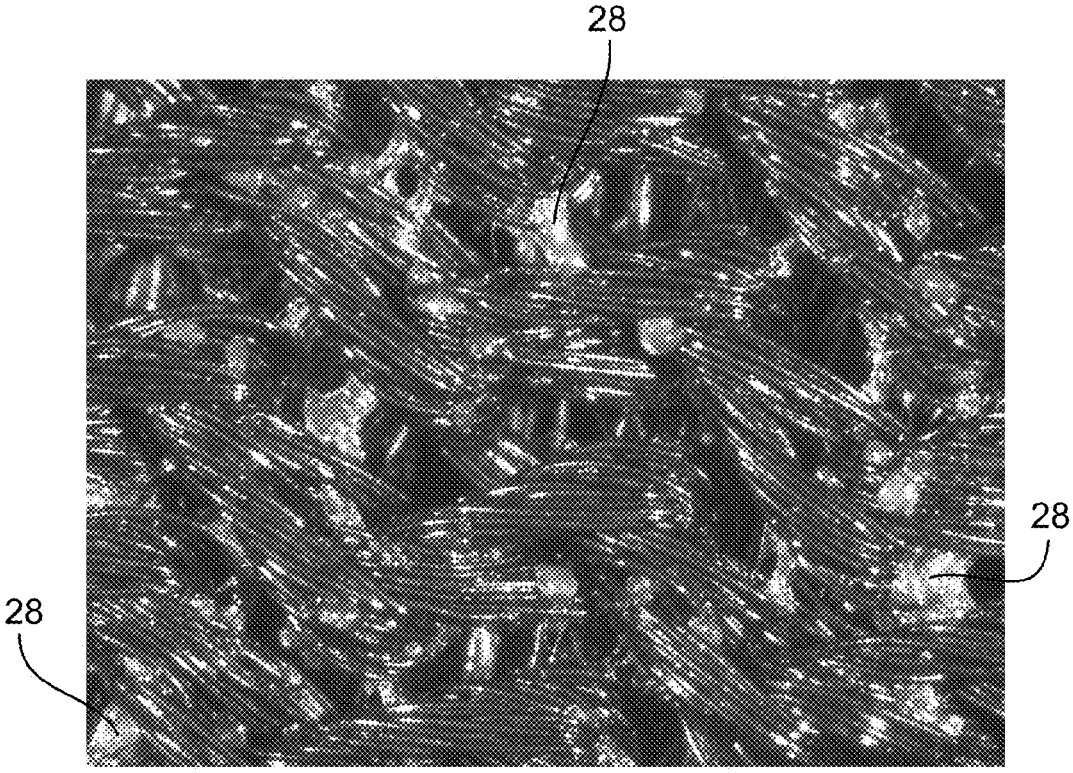
FIGS. 4 and 5 are enlarged photographs of surfaces of finished fabrics.
Figure 5:
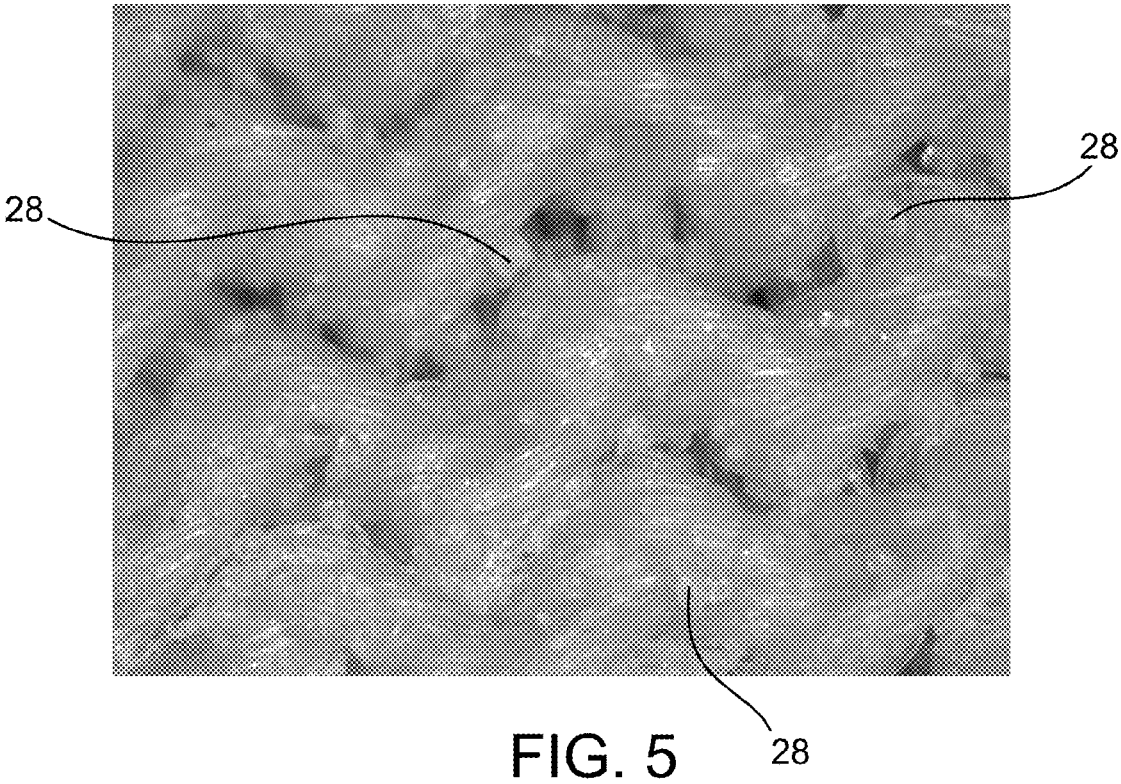
Figure 6:
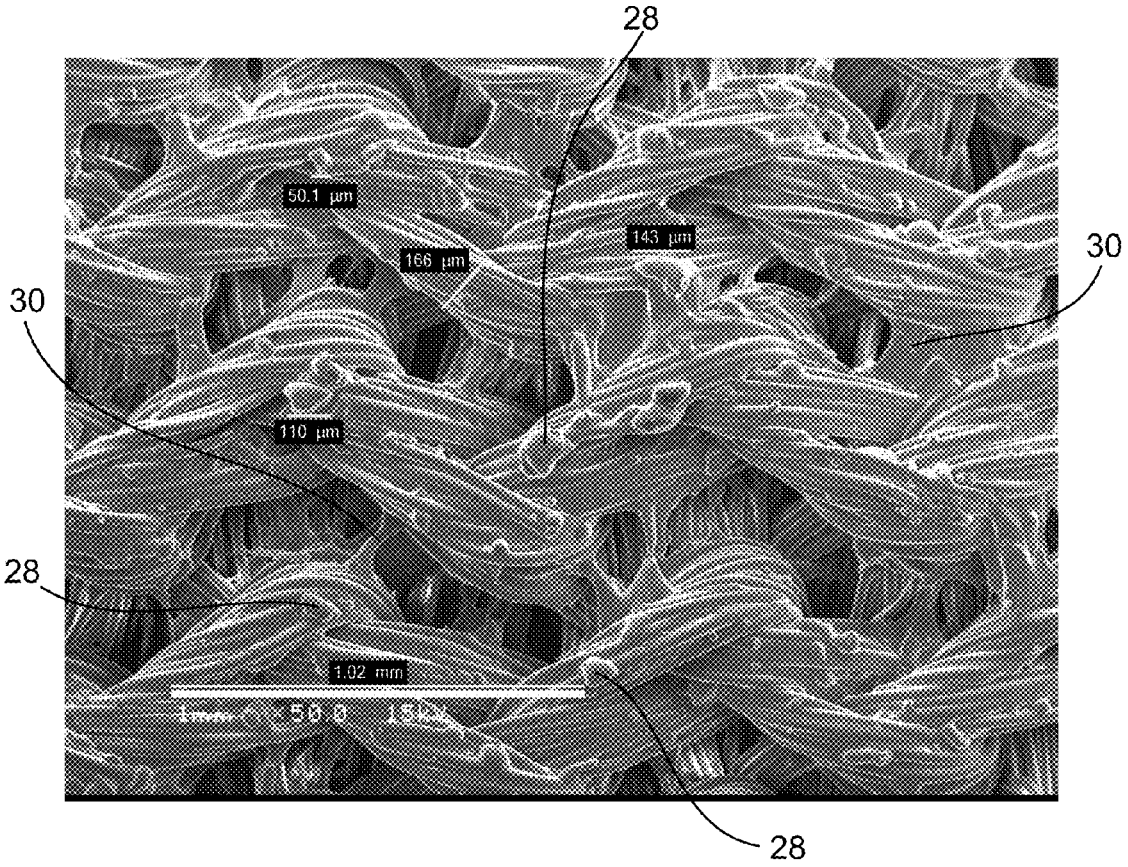
FIG. 6 is a SEM photograph of a finished fabric.

FIGS. 4 and 5 are enlarged photographs of fabric surfaces finished with a binder containing a powder 28, showing particles of the powder remaining on the fabric surface after finishing. FIG. 6 is a SEM photograph of such a fabric, also showing the binder 30 bonding the powder particles 28 to the fiber surfaces as well as bonding the fibers to each other. As can be seen from these photographs, the ground of the woven fabric is relatively porous. Given a measured thickness of the ground of the fabric and knowing the yarn material and the overall basis weight of the fabric, an 'equivalent ground porosity' can be calculated as the proportion of the volume of the fabric ground occupied by air. For example, given a measured ground thickness of 0.017 inch and a basis weight of 0.133 grams per square inch, knowing that the fabric is 68.3% by weight nylon pile fibers and 31.7% nylon ground fibers, estimating that 40-50% of the pile fiber is disposed within the ground (with the other 50-60% free of the ground and forming the pile loops), and taking the specific gravity of nylon to be 1.13, one can calculate an equivalent porosity of the fabric ground (prior to finishing) of about 72-75%. For fabrics with relatively high equivalent porosity, and depending on the precise nature of the weave and yarn properties, proper binder wicking while leaving a high proportion of the particles on the surface may require varying the binder viscosity. For some applications, fabrics with equivalent ground porosity of between about 55% and 80%, or in some cases between about 70% and 78%, are preferred. Such porosity allows the binder to wick into the ground and help to secure the loop fibers, while much of the adhesive remain at the ground surface in particle form.

Figure 7:
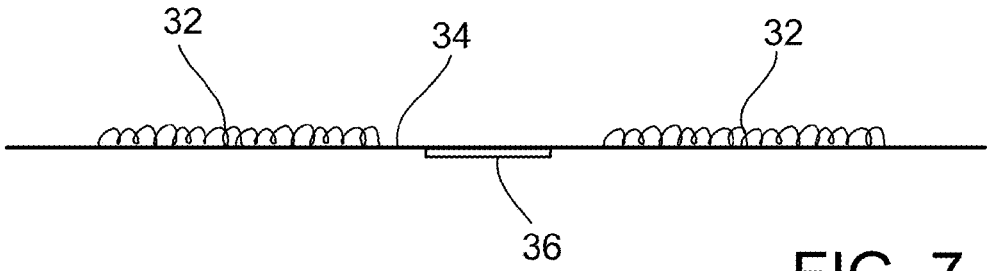
FIGS. 7 and 8 are schematic end views of a woven loop fabric, before and after being slit into two parallel strips.
Figure 8:
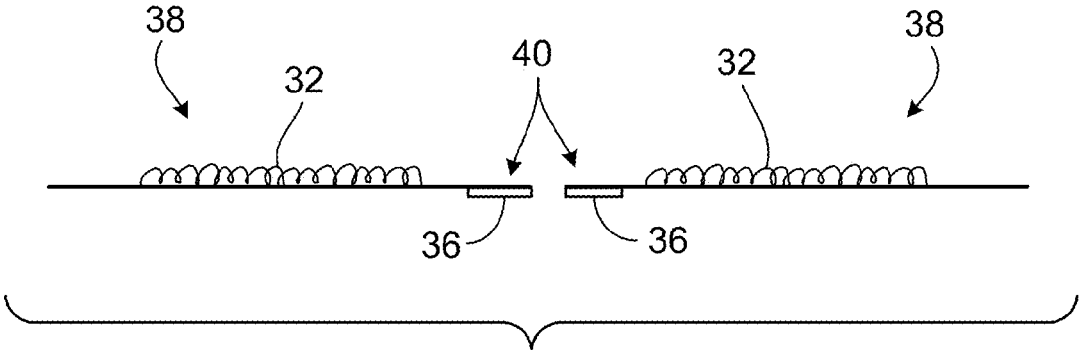

FIG. 7 illustrates a width of woven loop material having two longitudinally continuous fields of hook engageable loops separated by a strip of woven ground, the back side of which has been finished as described above, with a foamed powder/binder mixture applied in a narrow lane 36 and then dried. The application of the powder/binder mixture leaves activatable powder within lane 36. When the woven ground is later cut between the two loop fields to form two separate loop strips, as shown in FIG. 8, the powder within lane 36 is activated to help seize the free edges 40 formed at the cut. The powder may be activated by heat from a hot knife, for example, used to cut the ground, and may bond the severed fibers ends of the ground to help reduce the tendency of the edge to fray.

While a number of examples have been described for illustration purposes, the foregoing description is not intended to limit the scope of the invention, which is defined by the scope of the appended claims. There are and will be other examples and modifications within the scope of the following claims.

What is claimed is:

1. A method of bonding a fastener loop material to a mounting surface, the method comprising:

providing a fastener loop material having a surface opposite hook-engageable loops of the fastener loop material, the fastener loop material comprising particles of resin held to the fastener loop material by a dried binder and of a particle size larger than spaces between surface fibers of the fastener loop material, such that the resin particles are distributed primarily on the surface of the fastener loop material;

activating the surface of the fastener loop material to cause the particles of resin to soften; and bringing the surface of the fastener loop material into contact with the mounting surface, wherein softened particles of resin on the activated surface bond the fastener loop material to the mounting surface, with the hook-engageable loops of the fastener loop material exposed for hook engagement.

2. The method of claim 1, wherein the surface of the fastener loop material is activated after being brought into contact with the mounting surface.

3. The method of claim 1, wherein activating the surface of the fastener loop material comprises applying heat to raise a temperature of the resin particles above a softening point of the resin particles but below a melting point of the dried binder.

4. The method of claim 1, wherein activating the surface of the fastener loop material comprises applying energy at a radio frequency under conditions that cause the resin particles to soften without significantly softening the dried binder or resin of the loops.

5. The method of claim 1, wherein the particles of resin on the surface of the fastener loop material comprise a co-polyester powder.

6. The method of claim 1, wherein the mounting surface comprises vinyl and wherein the particles of resin on the surface of the fastener loop material also comprise vinyl.

7. The method of claim 1, wherein, as a result of the method, the fastener loop material is welded to the mounting surface.

8. The method of claim 1, wherein the fastener loop material, prior to activation, is air-permeable.

9. The method of claim 1, wherein the fastener loop material comprises a knit loop fastener material.

10. A method of bonding a fastener loop material to a mounting surface, the method comprising:

activating a surface of a fastener loop material opposite hook-engageable loops of the fastener loop material to cause particles of resin at the surface of the fastener loop material to soften, the particles being held to the fastener loop material by a dried binder; and bringing the surface of the fastener loop material into contact with the mounting surface, wherein softened particles of resin at the activated surface bond the fastener loop material to the mounting surface, with the hook-engageable loops of the fastener loop material exposed for hook engagement, and wherein the particles at the surface of the fastener loop material comprise a first set of particles formed of a first resin, and a second set of particles formed of a second resin, the first and second sets of particles having different activation properties, and wherein activating a surface of the fastener loop material comprises activating the first set of particles while the second set of particles remains substantially unactivated.

11. The method of claim 10, further comprising, after activating the first set of particles, and while the fastener loop material is bonded to the mounting surface, activating the second set of particles to enhance bonding of the fastener loop material to the mounting surface.

12. The method of claim 10, wherein the first set of particles forms a releasable bond with the mounting surface, and wherein activation of the second set of particles results in a permanent bond with the mounting surface.

13. The method of claim 1, further comprising, before activating the surface of the fastener loop material, unspooling the fastener loop material.

14. The method of claim 1, wherein, prior to activation, the particles of resin on the surface are held to the surface of the fastener loop material by a dried binder.

15. The method of claim 14, wherein the fastener loop material comprises a fabric, and wherein the particles of resin on the surface of the fastener loop material are of a powdered substance of the fastener loop material, a majority of which powdered substance is disposed on the surface of the fabric for bonding the fabric to the mounting surface upon activation.

* * * * *